US009194580B2

(12) United States Patent
Gminder et al.

(10) Patent No.: US 9,194,580 B2
(45) Date of Patent: Nov. 24, 2015

(54) BURNER FOR A THERMAL POST-COMBUSTION DEVICE

(75) Inventors: Christof Gminder, Reutlingen (DE); Apostolos Katefidis, Gaertringen (DE)

(73) Assignee: EISENMANN AG, Boeblingen (DE)

( * ) Notice: Subject to any disclaimer, the term of this patent is extended or adjusted under 35 U.S.C. 154(b) by 936 days.

(21) Appl. No.: 13/203,175

(22) PCT Filed: Feb. 23, 2010

(86) PCT No.: PCT/EP2010/001113
§ 371 (c)(1), (2), (4) Date: Nov. 7, 2011

(87) PCT Pub. No.: WO2010/097197
PCT Pub. Date: Sep. 2, 2010

(65) Prior Publication Data
US 2012/0037053 A1 Feb. 16, 2012

(30) Foreign Application Priority Data
Feb. 24, 2009 (DE) ..... 10 2009 010 274

(51) Int. Cl.
*F23B 10/02* (2011.01)
*F23D 14/24* (2006.01)
(Continued)

(52) U.S. Cl.
CPC ..... *F23D 14/24* (2013.01); *F23D 14/48* (2013.01); *F23D 14/58* (2013.01); *F23G 7/06* (2013.01); *F23D 2900/14481* (2013.01)

(58) Field of Classification Search
CPC ..... F23D 14/24; F23G 7/06
USPC ..... 431/116, 5, 183, 284
See application file for complete search history.

(56) References Cited

U.S. PATENT DOCUMENTS 2,368,178 A 1/1943 Turpin
2,366,517 A 1/1945 Gleason
(Continued)

FOREIGN PATENT DOCUMENTS

DE 680 057 A 7/1939
DE 692 09 243 T2 7/1996
(Continued)

OTHER PUBLICATIONS

Search Report dated Aug. 18, 2011 for corresponding PCT Appl. No. PCT/EP2010/001113.

*Primary Examiner* — Gregory Huson
*Assistant Examiner* — Nikhil Mashruwala
(74) *Attorney, Agent, or Firm* — Factor Intellectual Property Law Group, Ltd.

(57) ABSTRACT

The invention describes a burner for a thermal post-combustion device, which has a burner jet arranged in a housing. Arranged on the end region of the housing is a swirl apparatus, through which the exhaust gas to be purified can be made to flow. The burner jet comprises an outer tube and an inner tube, wherein it is possible for combustion gas to be made to flow through the interspace between said two tubes as far as an annular outlet gap in the end region thereof. The flow path for the combustion gas has a bottleneck in the vicinity of the outlet gap. In this way, a compact flame can be achieved, the form of which can be designated "bell-shaped" and which, for a given volume, has a relatively small surface. Although, such a flame has poor $CO_2$ values, the swirl apparatus ensures that the exhaust gas burns in the flame with very low $NO_x$ and CO values.

4 Claims, 2 Drawing Sheets

(51) Int. Cl.

| | |
|---|---|
| ***F23D 14/48*** | (2006.01) |
| ***F23D 14/58*** | (2006.01) |
| ***F23G 7/06*** | (2006.01) |

(56) References Cited

U.S. PATENT DOCUMENTS

| | | | | |
|---|---|---|---|---|
| 3,984,196 | A | 10/1976 | Zenkner | |
| 4,428,727 | A * | 1/1984 | Deussner et al. | 431/182 |
| 4,679,512 | A * | 7/1987 | Skoog | 110/347 |
| 4,846,666 | A * | 7/1989 | Bilawa et al. | 431/8 |
| 5,199,866 | A * | 4/1993 | Joshi et al. | 431/353 |
| 5,496,170 | A | 3/1996 | Primdahl | |
| 6,315,551 | B1 * | 11/2001 | Salzsieder et al. | 431/183 |
| 6,799,964 | B2 * | 10/2004 | Bidart | 431/5 |
| 2003/0108838 | A1 | 6/2003 | Bidart | |
| 2004/0219469 | A1 | 11/2004 | Katefidis | |
| 2007/0134608 | A1 | 6/2007 | Tautz | |
| 2009/0226852 | A1 * | 9/2009 | Feese et al. | 431/9 |

FOREIGN PATENT DOCUMENTS

| | | | |
|---|---|---|---|
| DE | 197 38 233 | A1 | 2/1998 |
| DE | 102 37 604 | A1 | 2/2004 |
| EP | 0 001 438 | A1 | 4/1979 |
| EP | 0 545 440 | B1 | 6/1993 |
| FR | 2 366 517 | A1 | 4/1978 |
| WO | WO01/42711 | A1 | 6/2001 |
| WO | WO2005/017411 | A1 | 2/2005 |

* cited by examiner

BURNER FOR A THERMAL POST-COMBUSTION DEVICE

RELATED APPLICATIONS

This application claims the filing benefit of International Patent Application No. PCT/EP2010/001113, filed Feb. 23, 2010, which claims the filing benefit of German Patent Application No. 10 2009 010 274.4 filed Feb. 24, 2009, the contents of which are incorporated herein by reference.

TECHNICAL FIELD

The invention relates to a burner for a thermal post-combustion device, comprising a) a housing;

b) a combustion nozzle, which is disposed in the housing and has a tube through which combustion gas can flow and that has at last one outlet opening for the combustion gas;

c) an eddy apparatus, which is attached to an end region of the housing and through which the exhaust gas to be purified can flow.

BACKGROUND OF THE INVENTION

Thermal post-combustion devices are intended to combust as completely as possible and with maximum efficiency, i.e. with a minimum burner power, the impurities entrained in the exhaust air requiring disposal. From the point of view of complete combustion, it would be favourable for the flame produced by the burner to be of a relatively high temperature; however, as the temperature increases, so does the formation of undesirable nitrogen oxides.

A burner of the type mentioned at the outset is described in DE 102 37 604 B4. The combustion nozzle used therein has a plurality of main outlet openings, via which the combustion gas flows out at a certain pressure in the radial direction. As a result of appropriate selection of the radial distance from the axis of the combustion nozzle at which the main outlet opening are disposed, and of the cross-section of the main outlet openings, individual flames, which substantially do not overlap one another, form at the main outlet openings. The obvious idea pursued in this case is that the compact ball of flame occurring in even earlier burners according to the prior art be broken up into a multiplicity of individual flames, each of which burns at a lower temperature than the ball of flame. This concept has proved thoroughly successful; however, there is the persistent need to further improve the characteristics of burners.

The present invention is directed to resolving these and other matters.

SUMMARY OF THE INVENTION

An object of the present invention is to design a burner of the type mentioned at the outset such that particularly good combustion values, particularly in respect of the formation of CO and $NO_x$, can be achieved with a simple structure.

This object may be achieved, according to the invention, in that d) the combustion nozzle comprises an outer tube and an inner tube, which, with their end regions, form an annular outlet gap;

wherein e) combustion gas can flow through the interspace between the outer tube and the inner tube, as far as the outlet gap;

f) the flow path for the combustion gas has a constriction in the vicinity of the outlet gap.

Since, according to the invention, the combustion nozzle is designed with an outer and an inner tube and, in particular, the constriction in the end region of the flow path, there is achieved, in combination with the exhaust air current, a particularly compact flame whose outer form can be described roughly as "bell-shaped". For a given volume, it has a comparatively small surface and, according to general opinion, is therefore not actually suitable for achieving good combustion values. It has been assumed hitherto that, in such compact flames, the combustion temperature is too high, and that excessively high values of $NO_x$ are therefore unavoidable.

According to the invention, however, it has been recognized that such a flame shape has a thoroughly positive effect, since it is made difficult for the oxygen to access the inner regions of the flame, which lowers the flame temperature there and results there in a flame burning in a reducing manner. Through the eddy apparatus, which, despite a compact flame, provides for complete combustion of the impurities entrained in the exhaust gas and of the combustion gas, in that flow eddies are generated between the exhaust air current and the gas ring, the invention avoids the negative consequence, feared by the specialists, of incomplete combustion with high CO values. These flow eddies first partially draw the outer regions of the flame backwards, which regions, however, are ultimately entrained by the exhaust air, such that complete oxidation of the combustible constituents is achieved at a low temperature of the combustion chamber.

Expediently, the constriction in the flow path of the combustion gas is achieved in that the outer tube, in its end region delimiting the outlet gap, has a portion that tapers conically in the direction of flow of the combustion gas. This portion causes the combustion gas in the vicinity of the outlet gap to be deflected towards the inner tube, promoting the formation of the desired flame shape.

Particularly advantageous is that embodiment of the invention wherein the inner tube has a groove, in particular of V-shaped cross-section, on its outer circumferential surface, in its end region delimiting the outlet gap. When this groove acts together with the conically tapering end region of the outer tube, there is produced a combustion-gas flow in which, to a singular extent, the ensuing flame has the desired characteristics.

In the case of the last-mentioned embodiment, it is additionally possible for the outer tube and the inner tube to be adjustable in relation to one another in the axial direction. In this way, it is possible to alter the effective area of the outlet gap, for example in order to adapt the burner to different capacities.

For reasons of space, finally, it is expedient if an ignition electrode is accommodated inside the inner tube.

It is to be understood that the aspects and objects of the present invention described above may be combinable and that other advantages and aspects of the present invention will become apparent upon reading the following description of the drawings and detailed description of the invention.

BRIEF DESCRIPTION OF THE DRAWINGS

An exemplary embodiment of the invention is explained more fully in the following with reference to the drawing, wherein.

DETAILED DESCRIPTION OF THE PRESENT INVENTION

Figure 1:
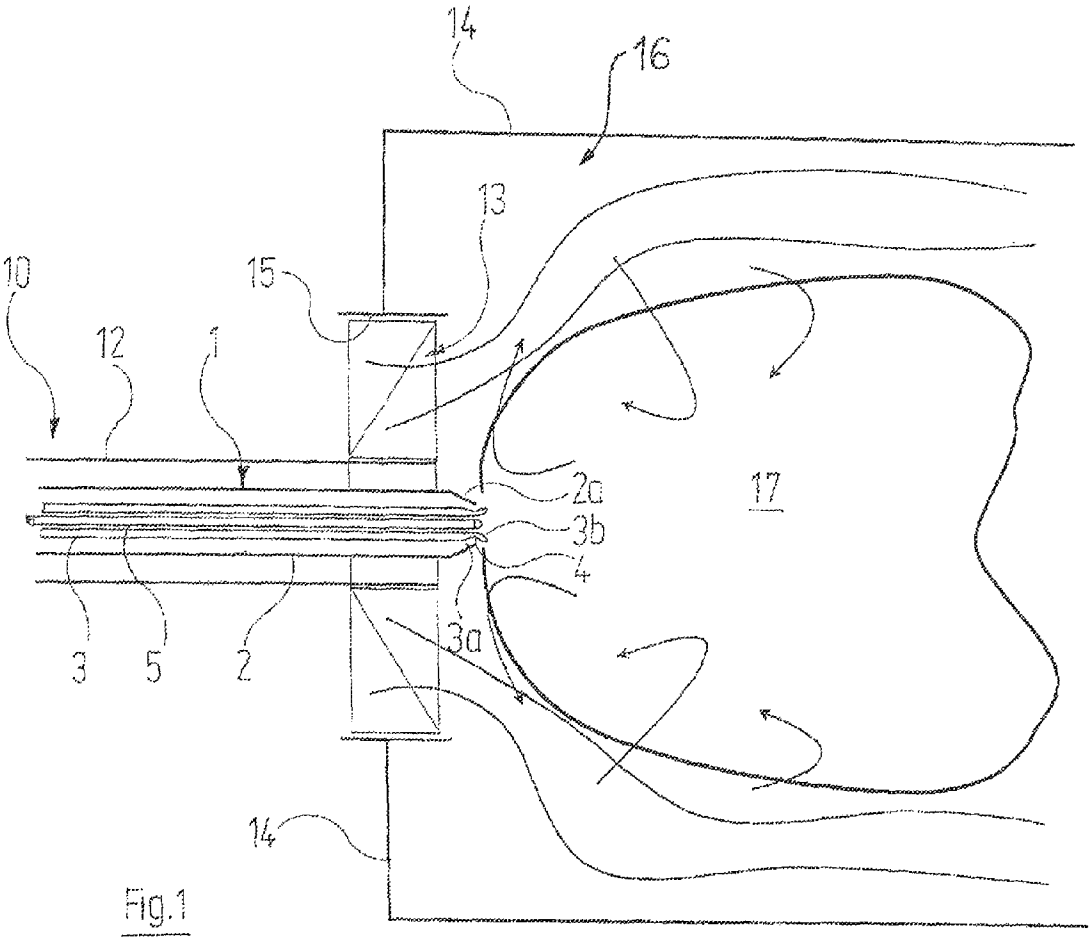
FIG. 1 shows an axial section through the region of a burner that is located inside the housing of a thermal post-combustion device.

While this invention is susceptible of embodiment in many different forms, there is shown in the drawings and will herein be described in detail one or more embodiments with the understanding that the present disclosure is to be considered as an exemplification of the principles of the invention and is not intended to limit the invention to the embodiments illustrated.

Reference is made first to FIG. 1. Represented therein is that region of a burner, denoted as a whole by the reference 10, that is disposed within the insulated outer housing of a thermal post-combustion device. On account of the "environment" in which this burner 10 is used, reference is made to DE 102 37 604 B4, already mentioned above. Unless otherwise stated in the following, the statements made therein concerning the connection, design and manner of operation of the burner 10 apply here in like manner. In particular, it also applies in this case that the burner 10 is introduced as a whole, with its free end region, into an opening 15 in a combustion chamber wall 14 of the thermal post-combustion device.

The burner 10 has a cylindrical burner housing 12, which, at its end that faces towards the combustion chamber 16, carries an eddy apparatus 13. This eddy apparatus 13 can likewise be constructed in the manner described in DE 102 37 607 B4. With its outer circumference, it bears more or less tightly on the opening 15 in the combustion chamber wall 14.

It is to be understood that additional embodiments of the present invention described herein may be contemplated by one of ordinary skill in the art and that the scope of the present invention is not limited to the embodiments disclosed. While specific embodiments of the present invention have been illustrated and described, numerous modifications come to mind without significantly departing from the spirit of the invention, and the scope of protection is only limited by the scope of the accompanying claims.

Positioned coaxially within the burner housing 12 is the actual combustion nozzle 1, which, for its part, comprises an outer tube 2 and, coaxially within the latter, an inner tube 3. The outer tube 2, at its free end region located within the combustion chamber 16, has a portion 2*a* that converges conically towards the end. The inner tube 3, on the other hand, in its end region located within the combustion chamber 16, has a portion 3*a* that tapers conically towards the end and, further towards the free end, has a portion 3*b* that widens conically again. In this way, a type of V-shaped groove 3*c* is produced in the outer circumferential surface of the inner tube 1. Between the free edge of the portion 2*a* of the outer tube 2 and the groove 3*c* there is an annular nozzle outlet gap 4.

Figure 2:
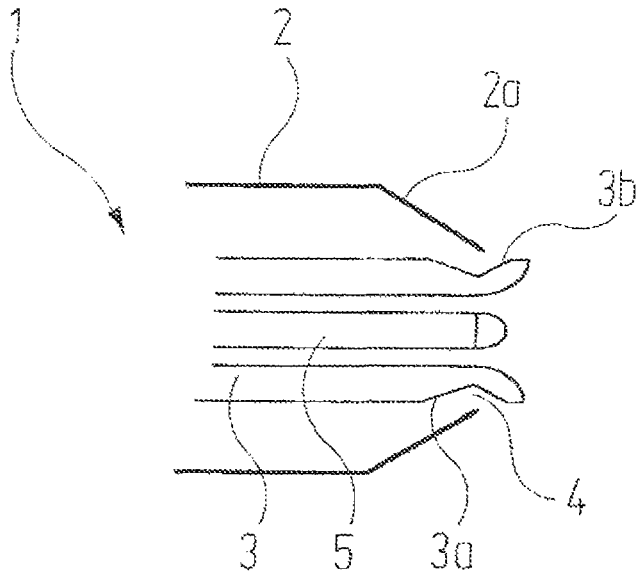
FIG. 2 shows, in enlarged scale, an axial section through the end region of the combustion nozzle of the burner of FIG. 1, in a first relative position of two inner components.
Figure 3:
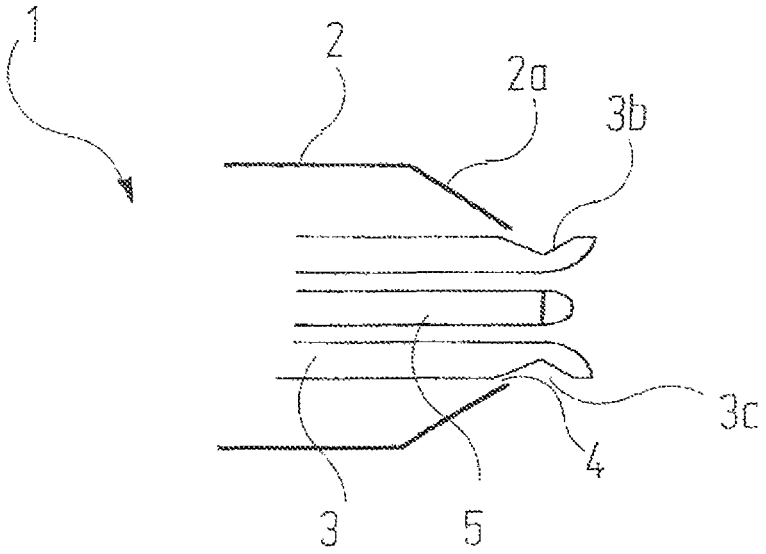
FIG. 3 shows a section, similar to FIG. 2, in which the inner components of the combustion nozzle are in a second relative position.

An axial relative movement is possible between the outer tube 2 and the inner tube 3 of the combustion nozzle 1. This can be effected either through axial displacement of the outer tube 2 or axial displacement of the inner tube 3. As a result, the cross-section of the effective outlet gap 4 of the combustion nozzle 1 can be altered. This becomes clear from FIGS. 2 and 3. Whereas, in FIG. 2, the free edge of the portion 2*a* of the outer tube 2 is approximately opposite the lowest point of the groove 3*c* of the inner tube 3 and, in this way, a nozzle gap 4 is produced that is as large as possible, in the relative position of FIG. 3 the free edge of the portion 2*a* of the outer tube 2 is located relatively close to the portion 3*a* of the inner tube 3 that tapers conically towards the end of the inner tube 3. In this relative position of the outer tube 2 and inner tube 3, the cross-section of the annular outlet gap 4 is seen to be relatively small.

The annular interspace between the burner housing 12 and the outer tube 2 of the combustion nozzle 1 is located in the field of view of a UV diode, which, in known manner, serves to monitor the combustion process.

In a manner not represented in the drawing, the annular interspace between the outer tube 2 and the inner tube 3 of the combustion nozzle 1 is connected to a combustion-gas source.

Finally, an ignition electrode 4 is inserted in the interior of the inner tube 3. The annular interspace between the inner tube 3 and the ignition electrode 5 can be fed with an ignition gas.

The burner 10 described above operates as follows:

The combustion gas is supplied at a certain pressure to the intermediate space between the outer tube 2 and the inner tube 3 of the combustion nozzle 1. Its flow velocity in this case can be increased in the supply line by a Venturi tube, as is known. The combustion gas then comes out through the outlet gap 4. In order to ignite the burner 10, ignition gas is introduced into the intermediate space between the inner tube 3 and the ignition electrode 5, and ignited by means of the ignition electrode 5. This then results, in turn, in the ignition of the combustion gas. After the outlet gap 4, in the direction of flow, a flame 17 then forms, whose outer contour resembles a bell. This means that, starting from the radius of the free edge of the outer tube 2, the flame 17 first widens relatively rapidly in the direction of flow, but then, further in the direction of the interior of the combustion chamber 16, becomes only just slightly larger towards the radius thereof, and finally also, again relatively rapidly, becomes smaller. This is represented schematically in FIG. 1. There is thus produced a flame 17 that, for a predetermined volume, has a relatively small surface.

The exhaust air to be purified flows, via the eddy apparatus 3, into the thus formed flame 17, the exhaust air in this case undergoing intense eddying around the flame 17. The impurities contained in the exhaust air are now combusted, both the formation of $NO_x$ and the formation of CO being suppressed in an effective manner.

As already mentioned above, the effective cross-section of the outlet gap 4 can be altered according to the quantity of accruing exhaust gas, in order thereby to obtain a flame shape that is optimal for the given application, as well as the least possible formation of $NO_x$ and CO.

The invention claimed is:

1. A burner for a thermal post-combustion device, comprising:

a housing;

a combustion nozzle, which is disposed in the housing and has a tube through which combustion gas can flow and that has at least one outlet opening for the combustion gas;

an eddy apparatus, which is attached to an end region of the housing and through which exhaust gas to be purified can flow; wherein, the combustion nozzle comprises an outer tube having an end region and an inner tube having an end region, with the end regions delimiting an annular outlet gap; and, wherein combustion gas can flow through an interspace between the outer tube and the inner tube, as far as the outlet gap; and, wherein a flow path for the combustion gas has a constriction in a vicinity of the outlet gap;

the end region of the outer tube has a portion that tapers conically in a direction of the flow of the combustion gas;

the end region of the inner tube has a groove on an outer circumferential surface of the end region of the inner tube;

the outer tube and the inner tube are adjustable relative to one another in an axial direction; and, an annular interspace between the housing and the outer tube of the combustion nozzle is located in the field of view of a UV-diode to monitor the combustion process.

2. The burner according to claim 1, wherein an ignition electrode is accommodated inside the inner tube.

3. The burner according to claim 1, wherein the groove has a V-shaped cross-section.

4. The burner according to claim 2, wherein the groove has a V-shaped cross-section.

* * * * *